United States Patent [19]

Rolff

[11] 4,160,140

[45] Jul. 3, 1979

[54] CONTACT ARRANGEMENT FOR PRESSURIZED-GAS CIRCUIT BREAKER

[75] Inventor: Klaus-Peter Rolff, Berlin, Fed. Rep. of Germany

[73] Assignee: Siemens Aktiengesellschaft, Munich, Fed. Rep. of Germany

[21] Appl. No.: 797,481

[22] Filed: May 16, 1977

[30] Foreign Application Priority Data

Jun. 10, 1976 [DE] Fed. Rep. of Germany ..... 2626245

[51] Int. Cl.[2] ..... H01H 33/18

[52] U.S. Cl. ..... 200/147 A; 200/147 R; 200/148 R

[58] Field of Search ..... 200/147 A, 147 R, 148 R

[56] References Cited

U.S. PATENT DOCUMENTS

| | | | |
|---|---|---|---|
| 2,725,446 | 11/1955 | Slepian | 200/147 A |
| 3,891,814 | 6/1975 | Hertz et al. | 200/147 R |
| 4,032,736 | 6/1977 | Ruffieux et al. | 200/147 R |
| 4,052,577 | 10/1977 | Votta | 200/147 R |

FOREIGN PATENT DOCUMENTS

| | | | |
|---|---|---|---|
| 1207988 | 12/1965 | Fed. Rep. of Germany | 200/147 R |
| 1246084 | 8/1967 | Fed. Rep. of Germany | 200/147 A |
| 189061 | 12/1966 | U.S.S.R. | 200/147 A |

*Primary Examiner*—Robert S. Macon

*Attorney, Agent, or Firm*—Kenyon & Kenyon

[57] ABSTRACT

A contact arrangement for use with a pressurized-gas circuit breaker wherein the nozzle arrangement is provided with a nozzle-shaped arc electrode having an annular slot disposed between its interior and exterior surfaces, and with an annular body of ferromagnetic material arranged in the aforesaid slot.

4 Claims, 3 Drawing Figures

CONTACT ARRANGEMENT FOR PRESSURIZED-GAS CIRCUIT BREAKER

BACKGROUND OF THE INVENTION

1. Field of the Invention

This invention relates to a contact arrangement for use with a pressurized-gas (gas blast) circuit breaker wherein the arrangement includes a nozzle-shaped arc electrode into whose interior runs an arc in the course of the interrupting action of the circuit breaker.

2. Description of the Prior Art

It is well known that the interrupting capacity of a high voltage circuit breaker and, in particular, a pressurized-gas circuit breaker can be enhanced by employing a magnetic force component acting on the arc to amplify the effect of the pressurized-gas stream blasting the arc. To accomplish this, a loop is formed which carries the arc current and brings about a magnetic driving force which lengthens the arc. A contact arrangement providing such a magnetic force component is disclosed, for example, in German Pat. No. 2,212,617. In the arrangement of the aforesaid patent, two coaxial nozzle tubes are arranged at a fixed distance from each other. Each of these nozzle tubes is provided with a slot running parallel to the axis of the tube and each has a U-shaped cross section between its interior and exterior surfaces at its respective end face.

It is an object of the present invention to provide a contact arrangement of the above type having an increased magnetic force for lengthening the current path of the arc, and thereby increasing the interrupting capacity of the high-voltage power circuit employing the arrangement.

SUMMARY OF THE INVENTION

In accordance with the principles of the present invention, the above and other objectives are accomplished in a contact arrangement employing a nozzle-shaped arc electrode having an annular slot disposed between its interior and exterior surfaces, and an annular body of ferromagnetic material arranged within the aforesaid slot.

With the contact arrangement so configured, the nozzle-shaped arc electrode of the arrangement causes the arc drawn between the aforesaid arc electrode and a further electrode of the arrangement, in the course of the interrupting action of the circuit breaker, to be cooled intensively, so that the conductive cross section of the arc is reduced or the resistance per unit length of the arc is increased. In addition, the annular body of ferromagnetic material of the contact arrangement causes the arc to be lengthened in the direction of the improving of the interrupting capacity of the breaker, thereby amplifying the aforesaid cooling effect. More specifically, the body of ferromagnetic material is magnetized by the magnetic field of the arc, i.e., a North pole and a South pole are formed. This magnetization of the ferromagnetic material produces at the location of the arc an induction which results in a magnetic force directed toward the electrode axis. This force, in turn, drives the arc further into the interior of the electrode.

The contact arrangement of the present invention is particularly suited for use with circuit breakers having a large distance between their nozzle-shaped arc electrodes, e.g., power circuit breakers for use with voltages in the range of 220 kV. The annular body of the contact arrangement of the invention may be formed of a ferrite material. Alternatively, the body may comprise a ring core wound of dynamo-sheet tape. Furthermore, the body, advantageously, may also be formed from a plurality of stacked laminated washers which are electrically insulated from one another.

It is also advantageous, with the present contact arrangement, to interpose a plastic material, such as, for example, PTFE tape, between the annular body and the arc electrode.

BRIEF DESCRIPTION OF THE DRAWINGS

The above and other features and aspects of the present invention will become more apparent upon reading the following detailed description in conjunction with the accompanying drawings in which.

DETAILED DESCRIPTION

Figure 1:
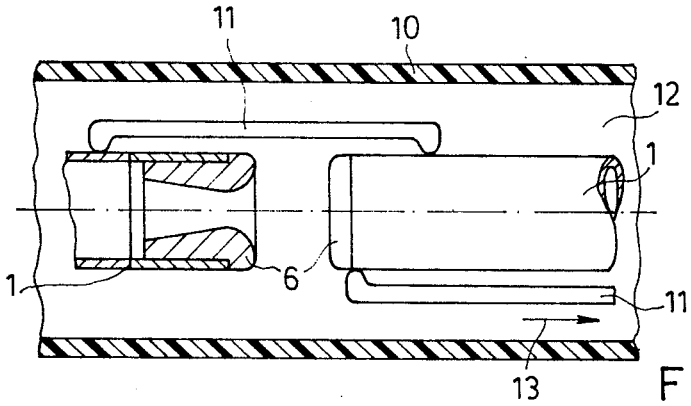
FIG. 1 shows a circuit breaker wherein a contact arrangement in accordance with the invention can be employed.

FIG. 1 shows a power circuit breaker and, in particular, a pressurized-gas circuit breaker wherein the contact arrangement of the present invention can be employed. The breaker comprises an arcing chamber 10 formed of a porcelain material and which contains a gaseous insulation medium, such as, for example, sulfur hexafluoride. In the interior 12 of the arcing chamber 10, two tubular contacts 1 are arranged in facing relationship. At their facing free end faces each of the contacts 1 supports a graphite electrode 6 which is intended to conduct the arc generated during the interruption of the breaker. Each of the graphite electrodes 6 has an annular, nozzle-shaped configuration thereby permitting the electrode to remove the hot gases produced while an arc is burning. As a result, in the course of the interrupting action of the breaker, the bases of the arc (not spots) are conducted through the interior of the nozzles into the tubular contacts 1.

As shown in FIG. 1, the portion of the breaker above the center line depicts the breaker in the "on" position, while the portion of the breaker below the center line depicts the breaker in the "off" position. Thus, in the "on" position, the two contacts 1 are connected to each other in an electrically conducting manner by a bridging contact element 11. In the "off" position, on the other hand, a gap exists between the two contacts 1, due to releasing of the contacts by the bridging contact element 11, which has previously been moved in the direction of the arrow 13.

Figure 2:
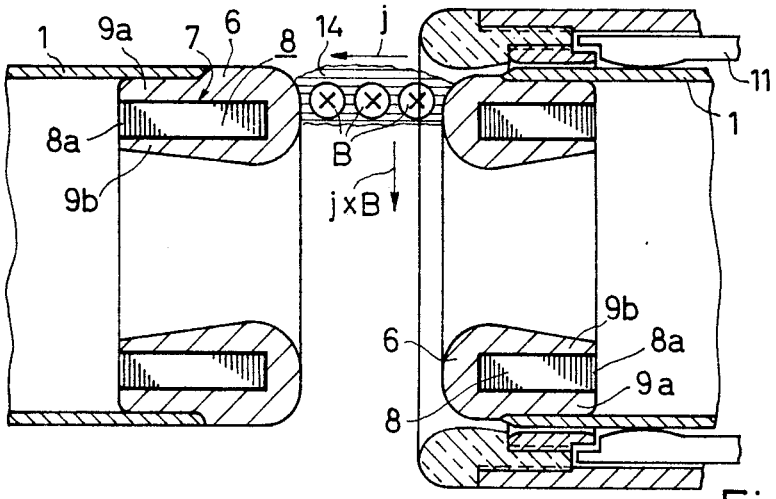
FIGS. 2 and 3 illustrate first, second embodiments of a contact arrangement in accordance with the principles of the present invention.
Figure 3:
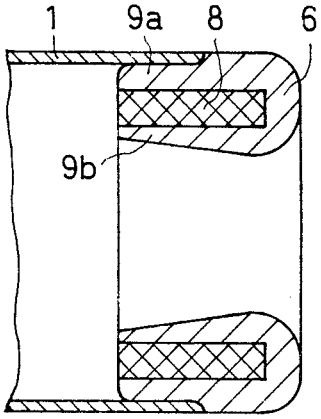

FIGS. 2 and 3 show the contacts 1 of the breaker of FIG. 1 modified in accordance with the principles of the present invention. More particularly, the electrode 6 of each contact 1 has an annular slot or space 7 disposed therein between its interior and exterior surfaces or walls. Thus, the cross section of each electrode between its interior and exterior surfaces is U-shaped, with the legs **9*a* and 9*b* of the electrode bordering the space or slot 7**.

In accordance with the invention, arranged in the slot 7 and, hence, between the legs **9*a* and 9*b* of each electrode is an annular body 8 comprised ferromagnetic material. As shown in FIG. 2, the annular body 8 is formed of a plurality of stacked laminated washers 8*a*** which are electrically insulated from one another and are made of dynamo-sheet material.

Each annular body 8, forms a ferromagnetic core which acts on the arc 14 burning between the arc electrodes 6. More particularly, the magnetic field of the arc 14 magnetizes the ferromagnetic material of each annular body 8. This magnetization produces at the locations of the arc 14, an induction B which, in combination with the current density j of the arc, results in a magnetic force $j \times B$, directed toward the axis of the electrodes. Under the action of this force, the entry of the arc into the interior of the tubular contacts 1 is accelerated, thereby simultaneously causing a rapid lengthening of the arc. Such lengthening, in turn, significantly increases the interrupting capacity of the breaker.

The embodiment of the contact arrangement shown in FIG. 3 is similar to the embodiment of FIG. 2, with the exception that the annular body 8 comprises a ferrite material, instead of a plurality of laminated washers. The operation of the contact arrangement of FIG. 3 is similar to that previously explained for the arrangement of FIG. 2 and, hence, will not be further discussed.

In both the embodiments of the invention shown in FIGS. 2 and 3, each annular body 8 can be arranged in its respective arc electrode 6 with the interposition of a plastic material. The plastic material may be, for example, cast resin or PTFE. Additionally, each annular body may be secured in its respective electrode by cementing the body into the annular space 7.

It should be further noted that in the aforesaid embodiments of the invention, each annular body 8 should, preferably, be electrically insulated from its respective electrode 6 in such a manner that the loop effect of the legs 9*a* and 9*b* is preserved.

What is claimed is:

1. In a contact arrangement for use in a pressurized-gas circuit breaker, the contact arrangement including a nozzle-shaped arc electrode into which an arc runs in the course of the interrupting action of said breaker, said electrode having an annular slot formed by a cross-section of the electrode between its interior and exterior surfaces which is U-shaped with first and second legs bordering the space, the improvement comprising:

(a) an annular body of ferromagnetic material arranged in said slot between said first and second legs; and (b) means insulating said annular body from said electrode.

2. The improvement of claim 1 wherein:

said ferromagnetic material is a ferrite.

3. The improvement of claim 1 wherein:

said annular body comprises a plurality of laminated washers arranged adjacent one another and electrically insulated from one another.

4. The improvement of claim 1 wherein said means for insulating comprise a plastic material arranged between said annular body and said arc electrode.

* * * * *